United States Patent [19]

Stubbs et al.

[11] Patent Number: 4,494,708

[45] Date of Patent: Jan. 22, 1985

[54] PAPER TAPE REWINDING DEVICE

[76] Inventors: James A. Stubbs, 631 Colfax Ct., Goleta, Calif. 93117; Eugene L. Gumplo, 116 Princeton Pl., Lompock, Calif. 93436

[21] Appl. No.: 601,783

[22] Filed: Apr. 18, 1984

[51] Int. Cl.[3] ..... B65H 17/02; B65H 23/26; B65H 17/18; B41J 29/00

[52] U.S. Cl. ..... 242/67.3 R; 242/68.4; 400/614; 235/58 CF

[58] Field of Search ..... 242/67.3 R, 68.4, 71.8, 242/129.6; 400/613, 614, 614.1; 235/58 P, 58 CF; 160/323 R

[56] References Cited

U.S. PATENT DOCUMENTS 1,604,794 10/1926 Sutton .
1,829,727 11/1931 Barrett .
3,025,014 3/1962 Casey .
3,033,481 5/1962 Wolk .
3,447,657 6/1969 Mayors .
4,065,068 12/1977 Treadwell .
4,168,038 9/1979 Nims .

FOREIGN PATENT DOCUMENTS

A 16349 10/1956 Fed. Rep. of Germany ..... 242/67.3 R

*Primary Examiner*—Stuart S. Levy
*Assistant Examiner*—Lloyd D. Doigan
*Attorney, Agent, or Firm*—Schwartz, Jeffery, Schwaab, Mack, Blumenthal & Koch

[57] ABSTRACT

The device includes a spool and a mounting structure for mounting the spool on a machine which uses paper tape. The mounting structure rotatably mounts the spool in a manner that the spool can rest on the paper tape roll of the machine and includes elements which rest against the back of the machine. The mounting structure is adjustable so that the axis of rotation of the spool is disposed between the axis of rotation of the paper tape roll and the surface of the machine such that the spool and the mounting structure are wedged between the surface of the machine and the roll.

6 Claims, 7 Drawing Figures

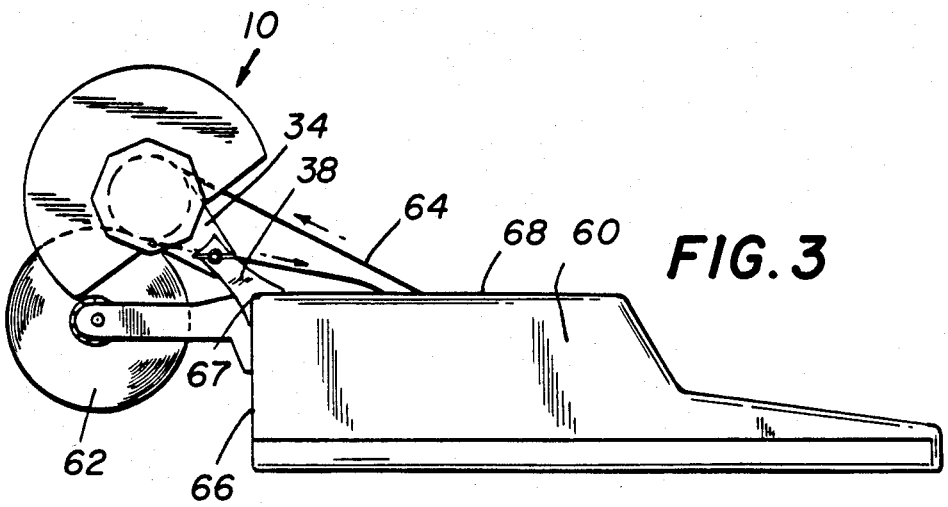
FIG. 3
FIG. 4
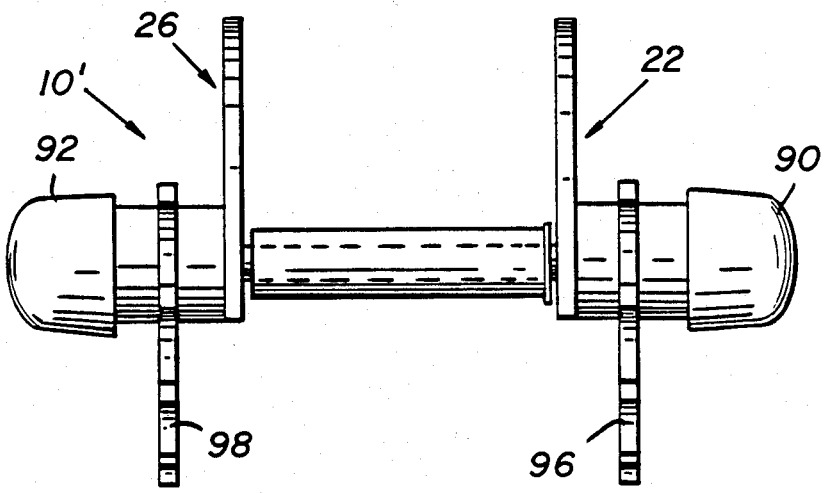
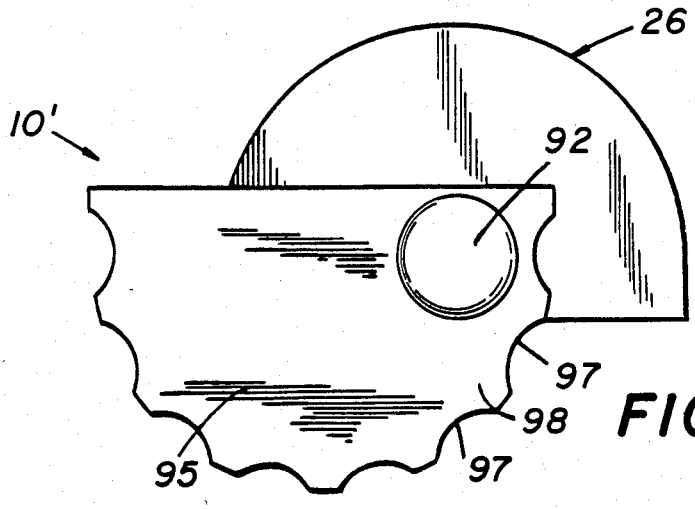
FIG. 5

PAPER TAPE REWINDING DEVICE

BACKGROUND OF THE INVENTION

1. Field of the Invention

The present invention relates to a device for rewinding paper tapes from adding machines, calculators or the like, and more particularly, to such a device which rewinds the paper tape in a manner which enables the tape to be reused on its blank side.

2. Discussion of Related Art

Adding machines, calculators and the like which produce a permanent printout on paper tape have become commonplace. In circumstances where the majority of the tape is not required to be separated into pieces and saved for purposes of, for example, record keeping, the tape is fed out from the machine in a continuous length. This tape may accumulate in an unsightly pile if not properly controlled.

Various devices have been suggested for rerolling used paper tapes. For example, U.S. Pat. No. 1,829,727 to Barrett shows a paper rewind for adding machines wherein an original roll of paper is mounted on a bracket. The bracket contains slots which mount a rewind roll. The rewind roll rests by gravity on the original roll.

U.S. Pat. No. 3,025,014 to Casey shows a removal attachment for rolling up the backing on double-sided tape. The attachment includes an arm which is connected to the base of the tape dispenser. A takeup arm is pivotally mounted to the first arm and mounts an axle which accepts a takeup spool. The takeup arm is spring-biased forwardly so that the takeup spool contacts the tape spool. A pair of guide arms are attached to the axle.

U.S. Pat. No. 1,604,794 to Sutton shows a paper strip rewinding mechanism having a supply spool and a takeup spool. The spools are rotatably mounted between a rigid upstanding side member and a movable side member. One of the spools is driven by the other spool through friction disks which engage each other through the action of a spring.

U.S. Pat. No. 4,168,038 to Nimms shows a tape reroll apparatus. In one embodiment of the Nimms apparatus, a first arm is connected to a supply roll, and a second arm is connected to a takeup roll. The arms are pivotally mounted to one another and biased together by a spring. One of the rolls rests on the other roll and is powered by movement of the other roll.

U.S. Pat. No. 3,447,657 to Majors shows a takeup reel for computers, calculators or the like which is powered by a motor.

U.S. Pat. No. 3,033,481 to Wolk and U.S. Pat. No. 4,065,068 to Treadwell show manually operated takeup reels.

However, none of the paper tape takeup devices known provides a simple and easy mounting structure to enable the device to be used on a plurality of different machines.

SUMMARY OF THE INVENTION

One object of the present invention is to provide a paper tape rewinding device which accepts paper tape and rewinds the paper tape onto a spool using the power of the feed roll.

Another object of the present invention is to provide a paper tape rewinding device which includes a mounting structure to enable the device to be mounted on a plurality of different machines such that the device is held in place principally by gravity and does not require any positive interconnection with the machine.

Yet a further object of the present invention is to provide a takeup device for paper tapes which device is relatively simple in construction and requires very few moving parts.

In accordance with the above and other objects, the present invention is designed for use with a machine having a tape holder for storing a roll of tape, and an automatic tape feed for pulling tape off the roll and feeding the tape such that a free end of the tape is accessible. The present invention is a tape rewind device comprising a spool, means for connecting a free end of the tape to the spool, and means for mounting the spool on the machine such that the spool rests on the roll and is rotated by the roll. The mounting means includes a mounting device for resting against a surface of the machine facing the roll. The mounting device is adjustable to permit an axis of rotation of the spool to be disposed between an axis of rotation of the roll and the surface such that the spool and the mounting device are wedged between the surface and the roll.

In accordance with other aspects of the present invention, the means for mounting the spool includes a mounting axle, and the mounting device includes a bifurcated end for resting against the back of the machine.

The mounting device may comprise an arm segment and a foot portion meeting at a joint, and means for adjusting the position of the arm relative to the foot.

Alternatively, the mounting device may comprise an element having a plurality of stops disposed at differing distances from the spool. The element may comprise a portion of a disk having a plurality of indentations along an outer edge, the disk being eccentrically mounted on the axle.

In accordance with other aspects of the invention, the device may include a pair of alignment elements mounted on opposite ends of the spool, the mounting elements being adapted to depend from the spool and contact opposite sides of the roll.

BRIEF DESCRIPTION OF THE DRAWINGS

The above and other objects of the present invention will become more readily apparent as the invention is more fully disclosed in the following detailed description, reference being had to the accompanying drawings in which like reference numerals represent like parts throughout, and in which:

FIG. 3 is a side elevational view showing the device mounted to a calculator;

FIG. 4 is a front elevational view of a second embodiment of the device of the present invention;

FIG. 5 is a side elevational view of the second embodiment;

DETAILED DESCRIPTION OF THE PREFERRED EMBODIMENTS

Figure 1:
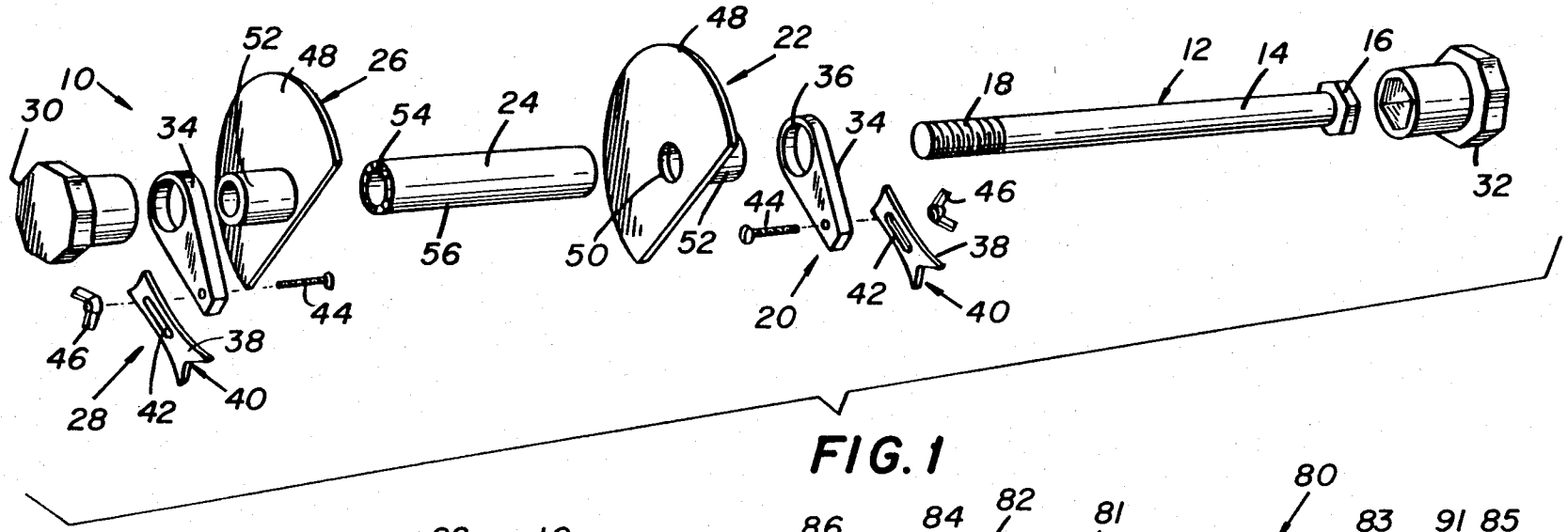
FIG. 1 is an exploded view of a first embodiment of the device of the present invention.
Figure 6:
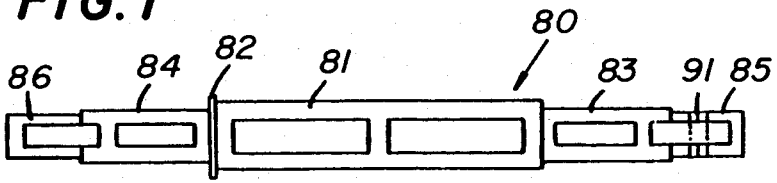
FIG. 6 is an elevational view of the one-piece shaft assembly used in the second embodiment.
Figure 7:
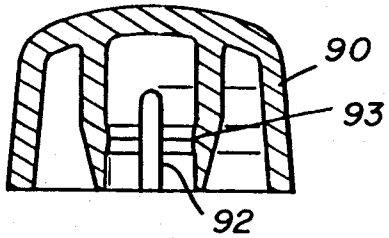
FIG. 7 is a cross-sectional view of one of the knobs used in the second embodiment.
Figure 2:
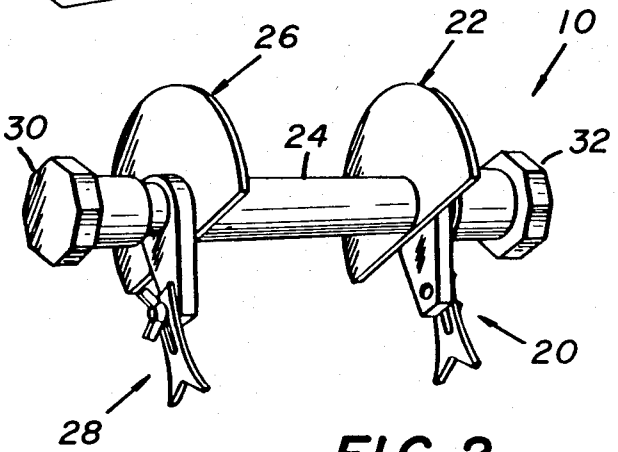
FIG. 2 is a perspective view of the first embodiment of the device of the present invention.

Now, with reference to FIGS. 1–3, the tape rewinding device 10 will be described in detail. Device 10 includes an axle in the form of a bolt 12 having a shaft 14, head 16 and threaded end 18. A positioning assembly 20 is positioned on the head end of shaft 14 together with a first alignment member 22. A spool 24 is mounted on shaft 12 between the first alignment member 22 and a second alignment member 26. A second positioning assembly 28 is positioned on the threaded end of shaft 12 with alignment member 26, followed by a threaded knob 30. A second knob 32 is mounted over head 16.

Positioning assembly 20 comprises a first arm 34 having an opening 36 in one end and a foot 38 having a bifurcated end 40. A slot 42 is formed in foot 38. Foot 38 is held against arm 34 by screw 44 which passes through an opening in the end of arm 34 and through slot 42. Wingnut 46 is received on the threaded end of screw 44. By loosening or tightening wingnut 44, the orientation of foot 38 can be changed relative to arm 34 both in length and in angular orientation. Positioning assembly 28 is exactly the same as positioning assembly 20.

Alignment member 22 includes a disk segment 48 having a central opening 50 and a cylindrical mounting boss 52 extending laterally from opening 50. Opening 50 is large enough to freely receive shaft 14 to permit shaft 14 to freely rotate therein.

Positioning assembly 20 is mounted on boss 52 by sliding opening 36 over boss 52. Opening 36 should fit snugly onto boss 52 so that the arm 34 cannot rotate easily relative to boss 52. Alignment member 26 is exactly the same as alignment member 22 and the relationship between member 26 and assembly 28 is the same as that between member 22 and assembly 20.

Spool 24 may be a convertion paper tape spool of honeycomb construction and has an inner opening 54 which is large enough to slide over shaft 14, but is snug enough that spool 24 rotates with shaft 14. A slot 56 may be formed in the outer wall of spool 24 to receive the free end of a paper tape to be wound on the spool.

To assemble device 10, assemblies 20 and 28 may be mounted on the cylindrical bosses 52 of members 22 and 26, respectively. Member 22 is then slid on shaft 14 followed by spool 24 which is followed by member 26. Threaded knob 30 is then screwed onto threads 18. Knob 32 may be slid over head 16 and glued or otherwise maintained in place. Knobs 30 and 32 lightly contact the bosses 52 on members 26 and 22, respectively, to hold the assembly together. It should be noted that knob 30 should not be screwed onto threads 18 so tightly as to prevent bolt 12 and spool 24 from rotating. A stop may be built into knob 30 so as to prevent overtightening of this nature.

FIG. 3 depicts an adding machine, calculator or other device 60 which uses a paper tape roll 62. The paper tape 64 is fed from roll 62 into the automatic paper feed of machine 60. Machine 60 has a rear wall 66 and a top wall 68 which meet at a rear corner 67. When mounting device 10 onto machine 60, members 22 and 26 are positioned so that their disk segments 48 are disposed on opposite sides of roll 60. Thus, the disk segments serve to align spool 24 directly over roll 60. Spool 24 is permitted to rest directly on roll 62 so that rotation of the roll causes counter-rotation of the spool. Feet 38 are adjusted relative to arms 34 of the positioning assemblies 20 and 28 such that the bifurcated ends 40 rest on the machine corner 67 formed where top wall 68 meets end wall 66. The length of these feet is adjusted such that the axis of rotation of spool 24 is positioned between the axis of rotation of roll 62 and end wall 66. The free end of tape 64 is then inserted into slot 56 and spool 24 is rotated several times by turning handles 30 and 32 to rotate bolt 12.

In operation, as machine 60 is operated and the tape feed pulls tape from roll 62, rotation of roll 62 produces a counter-rotation of spool 24 thus causing the used tape 64 to be wound on spool 24. The friction of spool 24 against roll 62 rotates the spool to wind the tape, and the weight of device 10 aids in producing this frictional force. Device 10 will continue to reroll the tape until roll 62 runs out. Spool 24 containing the used tape is then removed and mounted onto the machine 60 in place of paper roll 62. The tape is then fed into machine 60 such that the unused side of the tape is now printed on. A new spool 24 is mounted in device 10 and is used to rewind tape 64. Once both sides of tape 64 have been used, the tape can be discarded. It should be noted that alignment members 22 and 26 are mounted so that their disks not only extend downwardly on both sides of roll 62 but extend above and slightly forward of spool 24 so that they act as guides for tape 64 as it is wound onto spool 24. Thus, the rewound paper tape is positioned accurately on spool 24.

If, during operation, a section of tape 64 must be removed for records or the like, the section can be torn off in the usual manner and the tape spliced with cellophane tape or the like. Use of device 10 does not interfere with normal record keeping operations.

Device 10 can be modified to fit any type of machine 60. In order to accommodate different width tapes, all that need be done is to replace bolt 12 with a different length bolt and replace spool 24 with the appropriate size spool for the tape to be used.

FIGS. 4–7 show a second embodiment 10′ of the device of the present invention. Device 10′ differs from device 10 in its use of a one-piece shaft 80 which has a central portion 81 having a diameter sufficient to snugly mount a spool 24. A collar 82 is formed on one end of section 81 to form a stop for spool 24. Sections 83 and 84 extend from central section 81. These sections are dimensioned to receive the cylindrical bosses of members 22 and 26. Finally, end sections 85 and 86 receive knobs 90 and 92, respectively. Knob 92 can be glued in place whereas knob 90 is snap fitted onto section 85 so as to permit removal of spool 24. A notch 91 is cut in section 85 and knob 90 has a flexible inner portion which is slit at 92 and which contains raised surfaces 93 which engage the grooves 91 to produce the snap fit.

In place of positioning assemblies 20 and 28, a pair of adjustable foot sprockets 96 and 98 are mounted ont the cylindrical bosses of members 22 and 26, respectively. Sprockets 96 and 98 are identical. As shown in FIG. 5, each sprocket comprises an essentially semi-circular disk segment 95 with an offset mounting hole which fits onto a boss 52. A plurality of arcuate recesses 97 are formed in the periphery of disk segment 95. As shown, eight recesses 97 are included.

When mounting device 10′ onto machine 60, the sprockets 96 and 98 are simply rotated until the proper recesses 97 fit on the corner 67 formed by upper wall 68 and rear wall 66 so that spool 24 properly rests upon roll 62. Viewing roll 62 as a clock face, the proper position for spool 24 is between the 12:30 and 2:30 positions.

This provides the most effective operation of the device.

In order to adapt device 10' for use with different width tapes, a new shaft 80 must be provided having a central section 81 dimensioned to fit the proper size tape spool.

The foregoing description has been set forth for purposes of illustrating the present invention but is not intended to limit the scope thereof. Clearly, numerous substitutions and other changes can be made without departing from the scope of the invention as set forth in the appended claims.

What is claimed is:

1. For use with a machine having a tape holder for storing a roll of tape, and an automatic tape feed for pulling tape off said roll and feeding said tape such that a free end of said tape is accessible, a tape rewind device comprising:

a spool;

means for connecting said free end to said spool; and means for mounting said spool on said machine such that said spool rests on said roll and is rotated by said roll, said mounting means including a mounting member for resting against a surface of said machine facing said roll, said mounting member being adjustable to permit an axis of rotation of said spool to be disposed between an axis of rotation of said roll and said surface such that said spool and said mounting member are wedged between said surface and said roll.

2. A device as set forth in claim 1, wherein said spool is mounted on an axle, and said mounting member comprises a bifurcated end.

3. A device as set forth in claim 2, wherein said mounting member further comprises an arm portion mounted on said axle, and a foot portion mounted to said arm portion, and means for adjusting the relative orientation of said foot portion relative to said arm portion.

4. A device as set forth in claim 1, wherein said mounting member comprises an element with a plurality of stops at differing distances from said spool.

5. A device as set forth in claim 4, including a shaft mounting said spool, and wherein said mounting member comprises a disk segment and a plurality of indentations formed on an edge of said disk segment, and means for eccentrically mounting said disk segment on said shaft.

6. A device as set forth in claim 1, further including alignment elements mounted on opposite sides of said spool for being disposed on opposite sides of said roll, said mounting elements depending from said spool.

* * * * *